US010657764B2

(12) United States Patent
Li et al.

(10) Patent No.: US 10,657,764 B2
(45) Date of Patent: May 19, 2020

(54) SYSTEMS AND METHODS FOR SECURING VIRTUAL CURRENCIES AND ENHANCING ELECTRONIC PRODUCTS

(71) Applicant: Peerless Media Ltd., Gibraltar OT (GI)

(72) Inventors: Ran Li, Beijing (CN); Xiaoyu Ning, Beijing (CN); Yuehui Wan, Beijing (CN); Kexin Zhu, Beijing (CN)

(73) Assignee: Peerless Media Ltd., Gibraltar (GI)

( * ) Notice: Subject to any disclaimer, the term of this patent is extended or adjusted under 35 U.S.C. 154(b) by 43 days.

(21) Appl. No.: 15/635,403

(22) Filed: Jun. 28, 2017

(65) Prior Publication Data

US 2018/0005488 A1 Jan. 4, 2018

(30) Foreign Application Priority Data

Jun. 29, 2016 (CN) ..... 2016 1 0661902

(51) Int. Cl.
*G07F 17/32* (2006.01)

(52) U.S. Cl.
CPC ..... *G07F 17/3241* (2013.01); *G07F 17/3213* (2013.01); *G07F 17/3258* (2013.01); *G07F 17/3262* (2013.01); *G07F 17/3267* (2013.01); *G07F 17/3288* (2013.01)

(58) Field of Classification Search
CPC .. G07F 17/34; G07F 17/3267; G07F 17/3225; G07F 17/3227
See application file for complete search history.

(56) References Cited

U.S. PATENT DOCUMENTS 5,768,382 A * 6/1998 Schneier ..... A63F 13/12 380/251
5,779,549 A 7/1998 Walker et al.
6,244,958 B1 6/2001 Acres
(Continued)

FOREIGN PATENT DOCUMENTS

WO WO-0067424 A1 * 11/2000 ..... G07F 17/32
WO 2006036100 A1 4/2006
(Continued)

OTHER PUBLICATIONS

Roman V. Yampolskiy, "Detecting and Controlling Cheating in Online Poker," accessed on May 26, 2016, University at Buffalo, Buffalo, New York (6 pages).

*Primary Examiner* — Steven J Hylinski
(74) *Attorney, Agent, or Firm* — Beem Patent Law Firm

(57) ABSTRACT

Maintaining the integrity of a virtual currency and by reducing the impact of hacking and otherwise fraudulent manipulation of an electronic game, and thereby encouraging end users to use freemium model software, may include managing the distribution of virtual currency giveaways. In some embodiments, virtual currency may be distributed in a secure manner by a server. In addition, user interest also may be maintained by providing unique features such as a double-up mini-game that allows a user to wager an amount won on a winning slot reel spin. The user may select one of two options and either win or lose the amount wagered. In some embodiments, a user may wager more or less virtual currency by applying a multiplier to the amount won on the winning slot reel spin. In addition, user interest may be maintained by integrating story elements into the one or more themed slot games.

17 Claims, 12 Drawing Sheets

(56) References Cited

U.S. PATENT DOCUMENTS 6,984,173 B1* 1/2006 Piechowiak ..... G07F 17/32 463/20
8,047,909 B2 11/2011 Walker et al.
8,500,553 B2 8/2013 Olomskiy
8,960,676 B2 2/2015 Costa
8,992,319 B1 3/2015 Pascal et al.
9,050,530 B2 6/2015 Sivak
9,101,833 B2 8/2015 Behmaram-Mosavat et al.
9,211,474 B2 12/2015 Wilkinson et al.
9,216,358 B2 12/2015 Hess et al.
2002/0107072 A1* 8/2002 Giobbi ..... G07F 17/32 463/42
2003/0070178 A1 4/2003 Boyd
2003/0216168 A1* 11/2003 Cannon ..... G07F 17/32 463/25
2003/0216968 A1 11/2003 Barnhart
2004/0005919 A1* 1/2004 Walker ..... G07F 17/32 463/23
2004/0077408 A1 4/2004 D'Amico et al.
2004/0162132 A1* 8/2004 Jaffe ..... G07F 17/32 463/20
2004/0176167 A1* 9/2004 Michaelson ..... G07C 15/006 463/42
2006/0046817 A1* 3/2006 Paulsen ..... G07F 17/32 463/16
2006/0052168 A1 3/2006 Shacham
2006/0160612 A1 7/2006 Parham et al.
2006/0175758 A1 8/2006 Riolo
2006/0287067 A1 12/2006 White et al.
2006/0287103 A1 12/2006 Crawford et al.
2007/0232398 A1 10/2007 Aikin et al.
2007/0270211 A1 11/2007 Moshal
2008/0026816 A1* 1/2008 Sammon ..... G07F 17/32 463/20
2008/0026826 A1 1/2008 Groswirt
2008/0070659 A1 3/2008 Naicker
2008/0146351 A1 6/2008 Packes
2008/0194334 A1 8/2008 Kuok et al.
2009/0121438 A1 5/2009 Gustafsson
2010/0120490 A1 5/2010 McLaughlin et al.
2010/0227675 A1 9/2010 Luxton et al.
2011/0045909 A1 2/2011 Cole
2011/0105208 A1 5/2011 Bickley
2011/0177863 A1 7/2011 Davidson et al.
2011/0244952 A1* 10/2011 Schueller ..... G07F 17/32 463/27
2013/0029739 A1* 1/2013 Ramsey ..... G07F 17/326 463/16
2013/0296036 A1 11/2013 Scott
2014/0087855 A1* 3/2014 Caputo ..... G07F 17/3258 463/26
2014/0106858 A1* 4/2014 Constable ..... A63F 13/10 463/25
2014/0194199 A1 7/2014 DiGiovanni
2014/0370950 A1* 12/2014 Hansson ..... A63F 13/2145 463/9
2015/0031431 A1 1/2015 Burnside
2015/0072747 A1 3/2015 Burnside
2015/0119137 A1 4/2015 Alexander
2015/0221183 A1 8/2015 Colvin et al.
2015/0248814 A1 9/2015 Ottofy
2015/0254936 A1 9/2015 Stuppler
2016/0071369 A1 3/2016 Graves et al.
2016/0093169 A1 3/2016 Orcutt
2017/0124804 A1 5/2017 Nelson et al.

FOREIGN PATENT DOCUMENTS

WO 2007085054 A1 8/2007
WO 2014128735 A1 8/2014

* cited by examiner

300

400

500

600

700

800

1600

1700

1800

SYSTEMS AND METHODS FOR SECURING VIRTUAL CURRENCIES AND ENHANCING ELECTRONIC PRODUCTS

RELATED APPLICATIONS

This application claims priority from Chinese Patent Application No. 201610661902.9 filed Jun. 29, 2016, which is incorporated by reference in its entirety.

BACKGROUND OF THE INVENTION

1. Technical Field

This application is directed to the field of electronic products, and more particularly to the field of electronic products that use a "freemium" payment model.

2. Related Art

The "freemium" (free+premium) model allows developers to generate revenue on their products while each end user is able to choose how much, if any, money she spends on the product. Usually, freemium products operate by implementing some form of virtual currency. Virtual currency is an in-product item that has value in the product, but not in the real world. The virtual currency may have value in a game, for example, because it may be used to enhance the player's abilities, modify actions in the game, purchase other virtual items in the game such as appearance items or the like. In the case of games that involve betting or gambling, virtual currency may be wagered.

End users, or players, may earn virtual currency in a few different ways. For example, a game may provide virtual currency to a player if she completes certain tasks or activities in the game, such as playing the game a certain number of times, achieving a particular score, and the like. The game also may issue virtual currency as a bonus gift to the player based on various pre-determined parameters. If the virtual currency is used as a bet or wager, the end user may earn additional currency if she wins the bet or wager. Finally, some games allow end users to purchase virtual currency using actual currency.

As with all things of value, virtual currency and the games that use them are subject to manipulation by nefarious individuals attempting to obtain large amounts of virtual currencies. This is particularly true in games in which virtual currency may be both bought with actual money and obtained for "free" through in-game activities and the like (also called "giveaways"). In some cases, users may hack the game to get more giveaways than the system would otherwise distribute to the user. Hacking the game involves modifying the source code or otherwise manipulating the game software to achieve a particular outcome. As a simple example, players may change the clock setting on a computer to trick the game into performing a time-based action.

Other problems with freemium software, and in particular freemium games, is their short lifespans. Many freemium games enjoy significant initial success and popularity that dwindles over time, sometimes just weeks or months after the initial release. Because the profitability of freemium software is based on continued use, i.e. by generating revenue from advertisements or end users' purchase of in game currency, it is beneficial to find ways to maintain user interaction with freemium games after release. In addition, players often lose interest in a game if they feel the other players are exploiting virtual currency systems to gain an unfair advantage. Thus, it is critical to ensure that the integrity of the virtual currency is the maintained.

Accordingly, a need has long existed for improved systems and methods that solve the technical problems associated with hacking and otherwise fraudulently manipulating electronic games and that in turn encourages end users to use freemium model software.

SUMMARY

Maintaining the integrity of a virtual currency and by reducing the impact of hacking and otherwise fraudulent manipulation of an electronic game, and thereby encouraging end users to use freemium model software, may include managing the distribution of virtual currency giveaways. In some embodiments, virtual currency may be distributed in a secure manner by a server. In addition, user interest also may be maintained by providing unique features such as a double-up mini-game that allows a user to wager an amount won on a winning slot reel spin. The user may select one of two options and either win or lose the amount wagered. In some embodiments, a user may wager more or less virtual currency by applying a multiplier to the amount won on the winning slot reel spin. In addition, user interest may be maintained by integrating story elements into the one or more themed slot games.

Other systems, methods, features, and technical advantages of the invention will be, or will become apparent to one with skill in the art upon examination of the following figures and detailed description. It is intended that all such additional systems, methods, features, and technical advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention.

DETAILED DESCRIPTION OF THE PREFERRED EMBODIMENTS

The elements illustrated in the Figures interoperate as explained in more detail below. Before setting forth the detailed explanation, however, it is noted that all of the discussion below, regardless of the particular implementation being described, is exemplary in nature, rather than limiting. For example, although selected aspects, features, or components of the implementations are depicted as being stored in memories, all or part of systems and methods consistent with the contact management system architecture may be stored on, distributed across, or read from other machine-readable media, for example, secondary storage devices such as hard disks, floppy disks, and CD-ROMs; a signal received from a network; other forms of ROM or RAM either currently known or later developed; and the like.

Furthermore, although specific components of the communications architecture will be described, methods, systems, and articles of manufacture consistent with the contact management system architecture may include additional or different components. For example, a processor may be implemented as a microprocessor, microcontroller, application specific integrated circuit (ASIC), discrete logic, or a combination of other type of circuits or logic. Similarly, memories may be DRAM, SRAM, Flash or any other type of memory. Flags, data, databases, tables, and other data structures may be separately stored and managed, may be incorporated into a single memory or database, may be distributed, or may be logically and physically organized in many different ways, including unstructured data. Programs may be parts of a single program, separate programs, or distributed across several memories and processors. Systems may be implemented in hardware, software, or a combination of hardware and software in one processing system or distributed across multiple processing systems.

Figure 1:
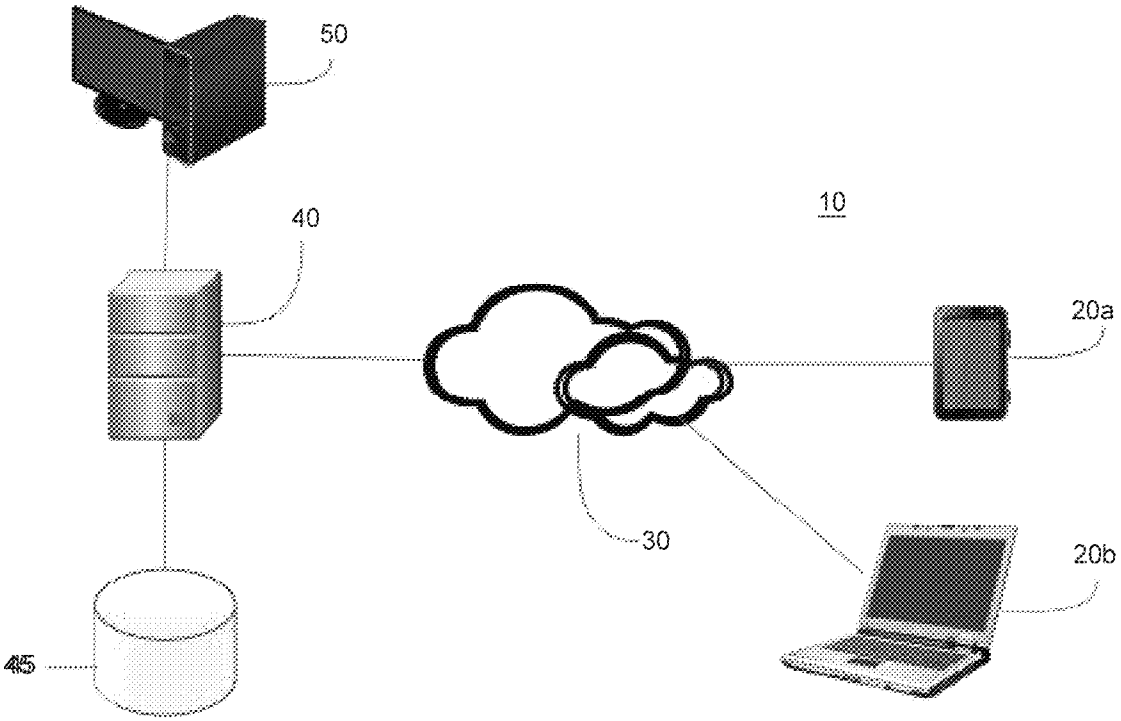
FIG. 1 shows an exemplary physical architecture for an exemplary system for providing an electronic game having a virtual currency.

As shown in FIG. 1, an exemplary architecture 10 for a system for providing an electronic game having one or more virtual currencies is shown. One or more client devices may run client applications 20*a* and 20*b* which may communicate with a game server 40 via a communications network 30. The client applications 20*a* may provide an interface to the user or player and provide game data to the game server 40. In response, the game server 40 may interpret that game data and issue new game data to the client devices 20*a* and 20*b*. The game server 40 may store information in one or more databases 45 and also may provide an administrative interface 50 that enables an administrator to interact with the server 40.

Although references will now be made to specific components of the system performing specific features, it should be apparent to one of ordinary skill in the art that such references are exemplary and are not intended to limit the scope of the claims in any way; furthermore, the functionalities described herein may be implemented in a virtually unlimited number of configurations. For example, the game server may be implemented as a single server configured to provide all of the systems functionalities, or the functionalities may be implemented across multiple servers.

The client applications 20*a* and 20*b* may provide a user interface for the system and may communicate device specific information, user profile information, game data and other information with game server 40 via communications network 30. In one embodiment, client applications 20*a* and 20*b* may comprise stand-alone applications which may be either platform dependent or platform independent. For example, client applications 20*a* and 20*b* may be stand-alone applications for a mobile phone configured to run on a mobile operating system such as the iOS™ operating system from Apple Inc. located in Cupertino, Calif., the Android™ operating system from Google, Inc. located in Mountain View, Calif., or the like. Alternatively, or additionally, client systems may connect to the game server via the Internet using a standard browser application. Alternatively, or additionally, one or more of the client applications 20*a* and 20*b* may be an application configured to run on mobile computer such as a laptop computer, handheld computer, tablet, mobile messaging device, or the like which may all utilize different hardware and/or software packages. Other methods may be used to implement the client devices 20*a* and 20*b*.

The communications network 30 may be any type any private or public communication network, such as the Internet, and may include one or more communications networks. In some embodiments, the communications network 30 may be a cellular network such as, for example, a Code Division Multiple Access (CDMA) network, Global System for Mobiles (GSM) network, General Packet Radio Service (GPRS) network, cdmaOne network, CDMA2000 network, Evolution-Data Optimized (EV-DO) network, Enhanced Data Rates for GSM Evolution (EDGE) network, Universal Mobile Telecommunications System (UMTS) network, Digital Enhanced Cordless Telecommunications (DECT) network, Digital AMPS (IS-136/TDMA), Integrated Digital Enhanced Network (iDEN), Long-Term Evolution (LTE) and the like.

The game server 40 may store game data, user profile information and related information in a database 45, receive game data, device data, and user profile information from a client application 20*a* and 20*b*, implement game logic, provide a user interface for an administration interface 50, and the like. As should be apparent to one of ordinary skill in the art from the disclosure herein, other related services may also be provided.

The database 45 may store a variety of information, including user profile information, user preference information, game data, tournament data, and the like. In some embodiments, all information stored in the database 45 is encrypted.

Exemplary Slot Game Using Virtual Currency and Integrated Story Elements

Although reference will now be made to certain embodiments described herein with reference to a slot game that utilizes a computer environment to combine animations, sounds, characters, and other aspects to create a unique slot machine game experience, the principles presented herein may be used for other games, such as poker, black jack, roulette and the like. In addition, the embodiments presented here may also be used in non-casino games that use virtual currencies. The embodiments illustrated herein should therefore not be interpreted to be exclusive or limiting, but rather exemplary or illustrative.

Figure 2:
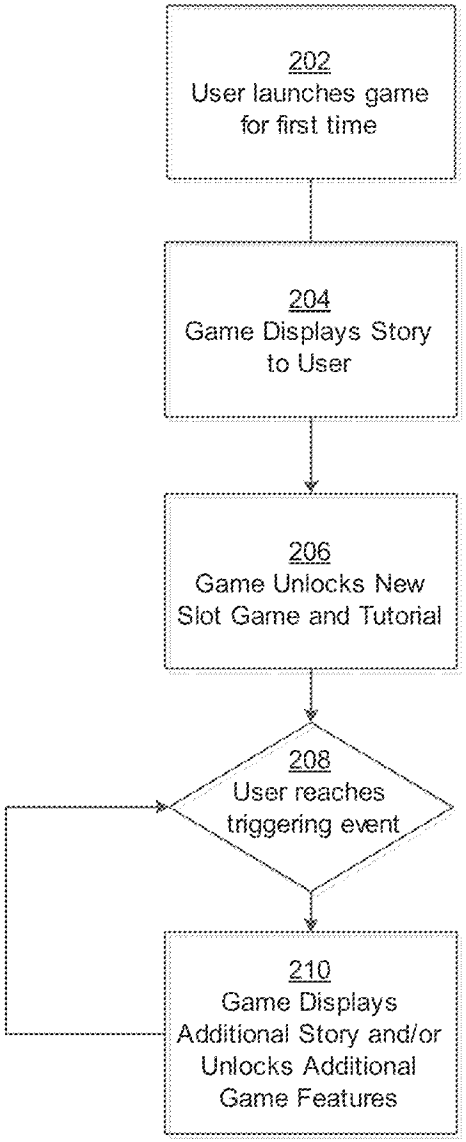
FIG. 2 shows a flowchart of an exemplary process for providing a secure slot game integrated with story elements.
Figure 3:
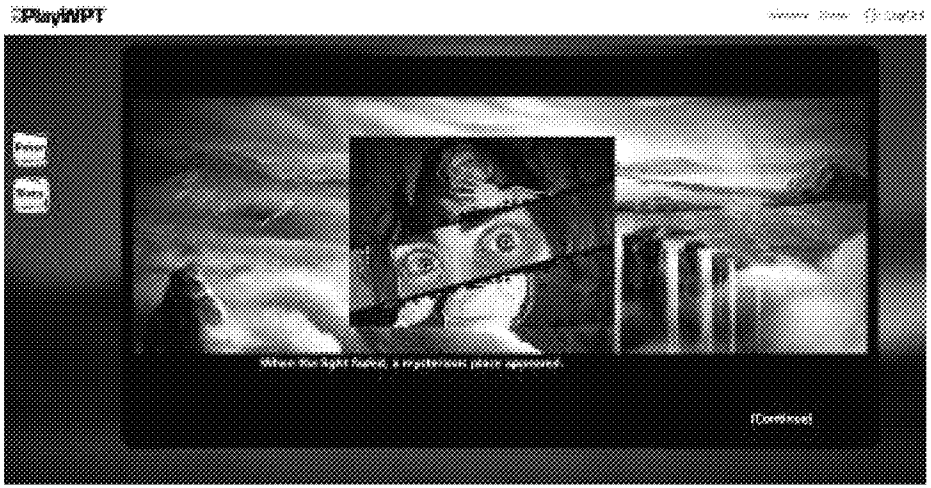
FIGS. 3-8 show exemplary screen shots of an introductory story and tutorial mode interlaced with story elements.
Figure 4:
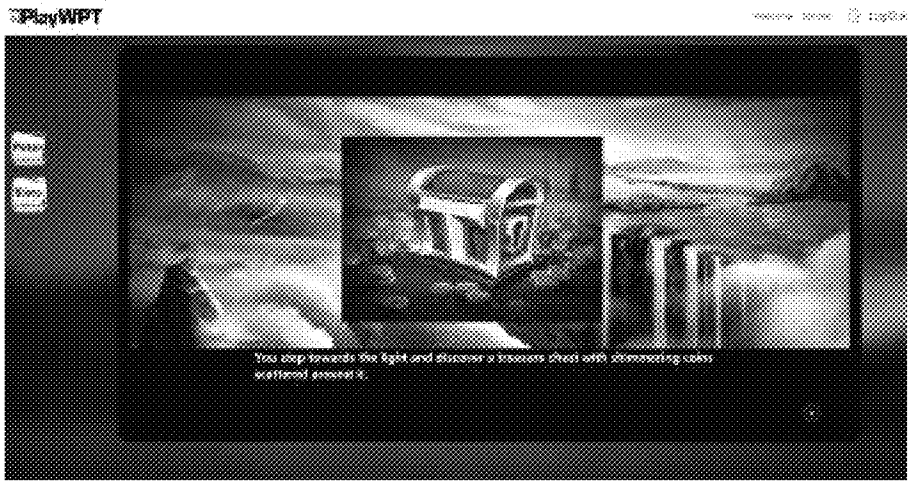
Figure 5:
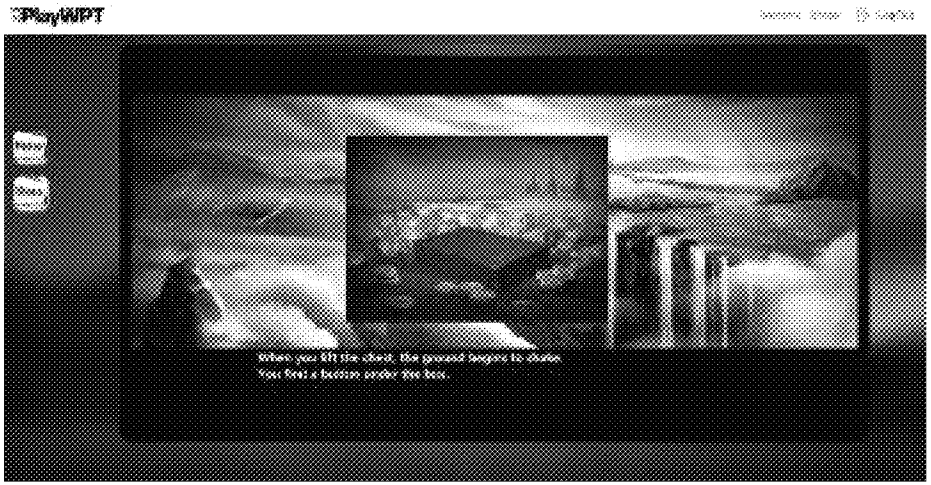

Referring to FIG. 2, a flowchart of an exemplary process for providing a secure slot game integrated with story elements is shown. A player may launch the game for the first time at step 202. In response, the game may guide the player through an introductory story at step 204. Exemplary screen shots 300, 400 and 500 showing certain aspects of an introductory story and tutorial are shown in FIGS. 3-5. The story elements may include visual and/or audio such as sound effects and/or voice recordings that may tell a story. In the illustrated embodiment, the story elements depict a man trying to find his girlfriend, who has mysteriously disappeared.

Figure 6:
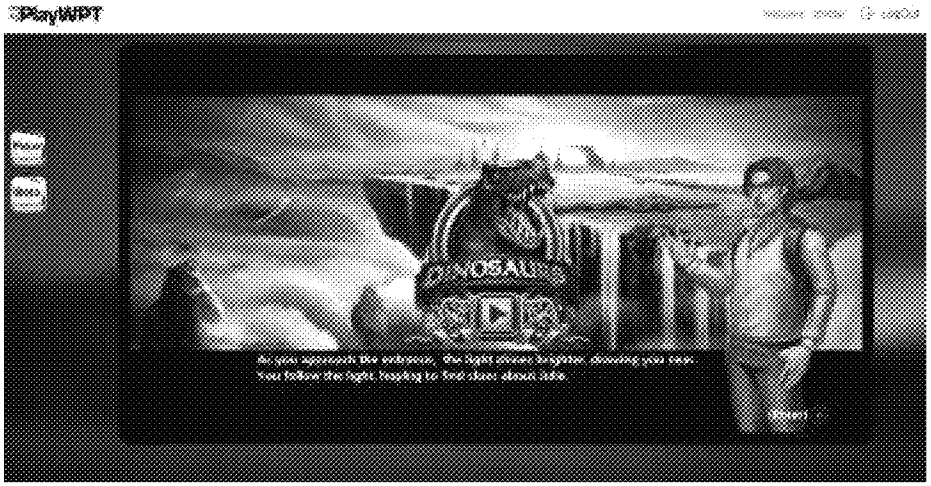
Figure 7:
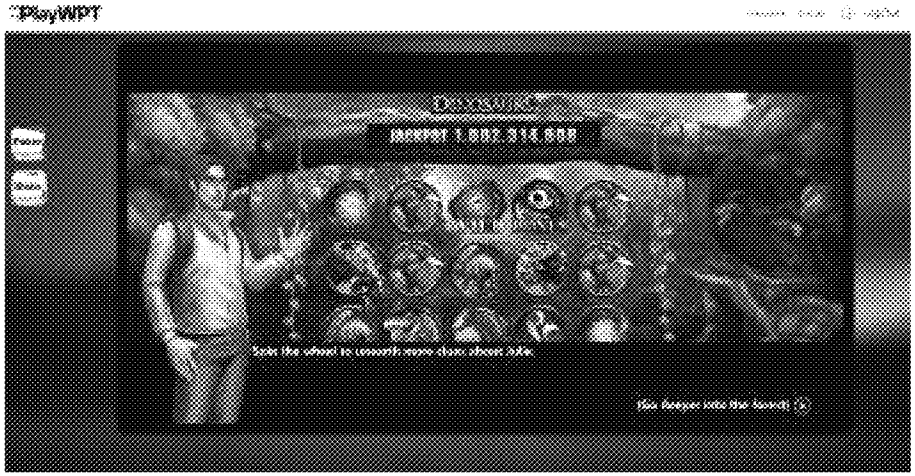
Figure 8:
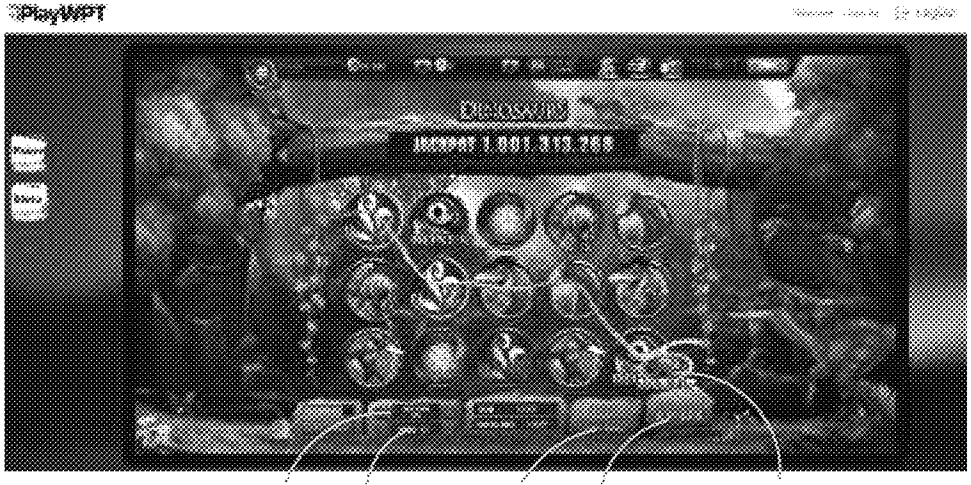

Following the introduction, the player may be guided through a tutorial mode beginning with the introduction of a slot game at step 206 and as shown in the exemplary screenshot 600 shown in FIG. 6. In the embodiment illustrated in FIG. 6, the player is introduced to a dinosaur themed slot game. The tutorial may continue the depiction of the story elements while explaining various game mechanics to the player. For example, the tutorial may teach the player how to spin the slot reels using interface control 822, as shown in the exemplary screenshots 600 shown in FIGS. 7 and 8. In some embodiments, the tutorial may teach the user one or more of the following mechanics: how to increase or decrease the number of line in play using interface controls 826, how to increase or decrease the amount of virtual currency wagered per line using interface controls 824, how to configure an auto-roll feature whereby the game automatically plays a set number of spins using and/or max bet feature interface control 830. In addition, the tutorial may introduce an additional game feature that allows players to wager their winnings to increase the amount of virtual currency they earn by selecting the corresponding interface control 840, described below with respect to FIGS. 10*a* and 10*b*.

Referring again to FIG. 2, the player may continue to play the slot game. When a story triggering event is encountered at step 208, the game may display additional story elements and/or unlock additional game features to the user at step 210. The player may then continue playing and the process may repeat. Exemplary triggering events may include reaching a particular experience level, playing a certain number of spins, accumulating a certain number of virtual currency, and the like. For example, triggering events may be tied to a player's experience level, and new slot game may be unlocked every 5 levels. Other triggering events also may be used. Exemplary game features may include new themed slot games and the like.

Secure Distribution of Rewards

The game may distribute rewards in a variety of ways. For example, rewards of virtual currency may distributed from winning reel combinations on payout lines the player bet on. Rewards of virtual currency also may be distributed through reward mini-games. In some embodiments, all payouts may be distributed from a progressive pot. Some or all of a players wager may be added to the progress pot. For example, three percent (3%) of a player's wager may be added to the progressive pot.

In some embodiments, the game may include one or more of the following reward mini-games that may help increase user retention and interest in the game. A first reward mini-game may be the Double-Up feature noted above and described in more detail below in connection with FIG. 10*a-b*. The Double-Up feature may allow players to wager their winnings from winning line combinations to increase the amount of virtual currency they earn. A second reward mini-game may be a time-gated reward chest, described below in connection with FIGS. 11 and 12. A third of these reward mini-games may be a Daily Bonus feature, which may provide players with increasing rewards in the form of virtual currency for logging into the game for consecutive days. This feature is described below in connection with FIGS. 13*a-b*. These features may help draw in the end user into the game by providing additional in-game rewards and through the end user's desire to progress the story.

Figure 9:
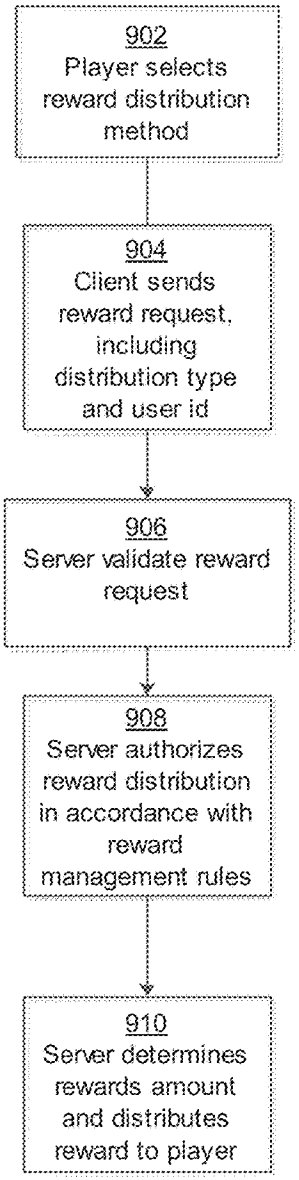
FIG. 9 shows a flowchart of an exemplary process for securely distributing rewards.

Referring to FIG. 9, a flowchart of an exemplary process for securely distributing rewards is shown. The player may begin the process of obtaining a reward by selecting a reward distribution method, such as the spin button 822 (in FIG. 8) at step 902. In response, the client application 20*a* may send a request for a reward to the game server 40 at step 904. The game server 40 may validate the request at step 906 and authorize the distribution of the reward in light of reward management rules at step 908. If the request is valid and the distribution is authorized, the server 40 may determine a reward amount to the player via the client application 20*a* at step 910. Rewards may be authorized, for example, if the reward is in compliance with reward management rules for associated with the reward distribution method. For example, the server 40 may provide a reel spin configuration (i.e. the configuration of the reels at rest following a spin) and, if the reel spin configuration includes a winning combination on a line on which the player has wagered, a payout amount. The reward amount may be fixed amount, such as $500 in silver coins or may be selected randomly from a set of possible rewards as described below. Other methods may be used to determine a reward amount.

Exemplary Reward Distribution Methods

Figure 10A:
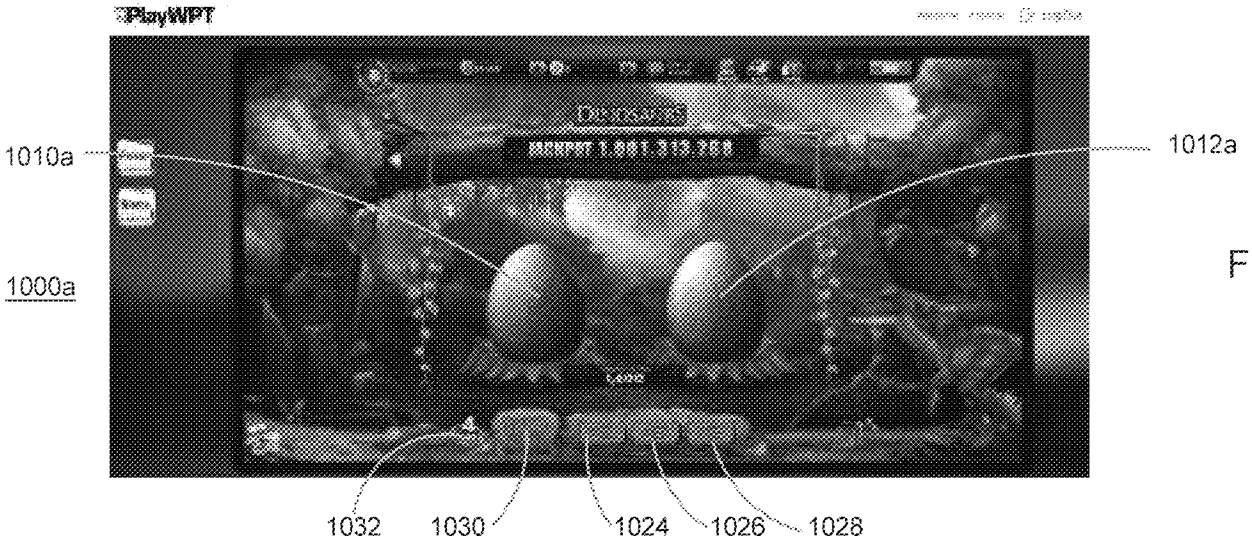
FIGS. 10*a-b* show exemplary screen shots of a double-up mini-game provided as part of an electronic slot game.
Figure 10B:
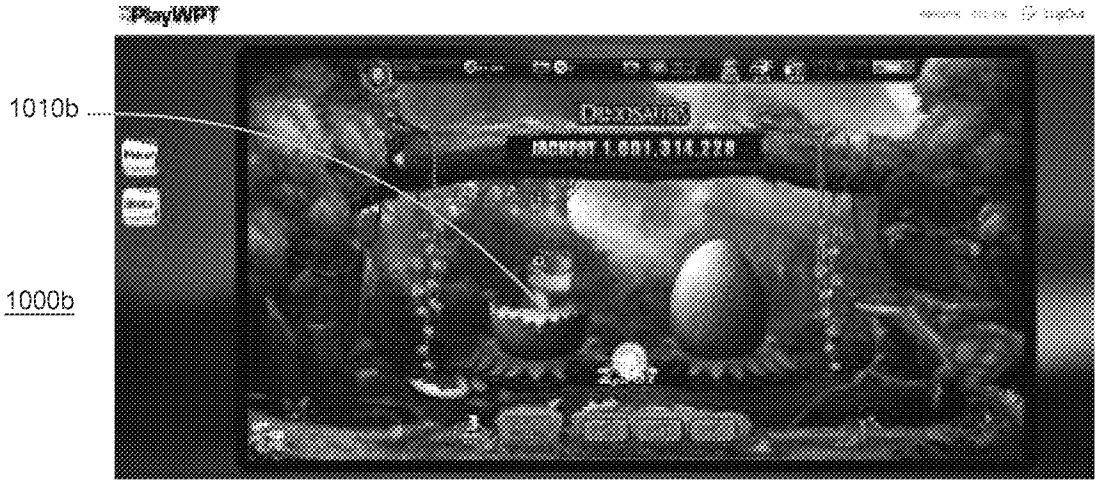

Referring to FIGS. 10*a* and 10*b*, exemplary screen shots 1000*a* and 1000*b* of a double-up mini-game provided as part of an electronic slot game are shown. After a player wins virtual currency when a winning line combination is spun on the slot reels, the player may be given an option to play a double-up reward mini-game by selecting a corresponding interface control (such as interface control 840 in FIG. 8). In response, the player may be presented with two choices, such as dinosaur eggs 1010*a* and 1012*a*. Selection of one of the options may trigger the exemplary process shown in FIG. 9, and the user may either win or lose an amount of virtual currency equal to the payout of the player's previous winning reel spin. For example, as shown in FIG. 10*b*, the player has successfully chosen the winning egg 1010*b* and the game has shown the user a baby dinosaur and distributed the wagered amount to the player. In some embodiments, the player may have the option to wager a multiple of the payout of the player's previous winning reel spin, such as one-half of the payout, two times the payout, three times the payout, five times the payout and the like by selecting various interface controls such as interface controls 1024, 1026 and 1028.

In some embodiments, the player may have predetermined number of chances 1032 to play the double-up mini-game for each winning reel spin. In the embodiment illustrated in FIG. 10*a*, the user has 4 chances to play the double-up mini-game. Chances 1032 may be lost when the user loses at the double-up mini-game, or when the play either wins or loses at the double-up mini-game. If the player runs out of chances 1032, the player may be returned to the reel for that particular slot game. Alternatively, the play may choose to leave the reward mini-game without selecting either of the two options and instead take whatever winnings the player has accumulated by selecting the control 1030. In some embodiments, players may be given a default number of chances that increase as the player level's up, such as granting the player an additional chance for every 5 levels earned by the user.

Figure 11:
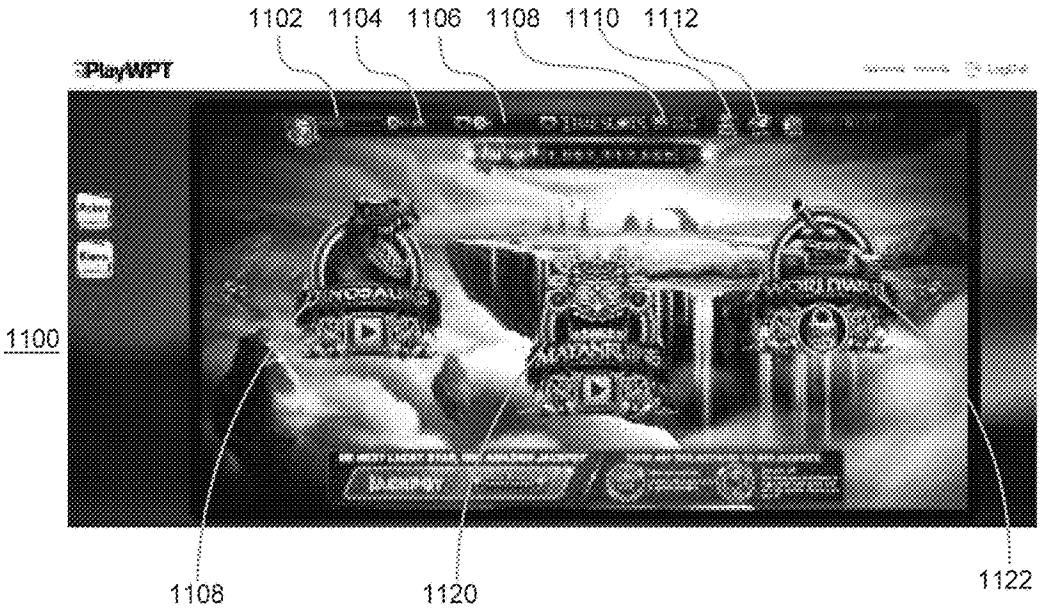
FIG. 11 shows an exemplary screenshot of a main lobby for a slot game.
Figure 12:
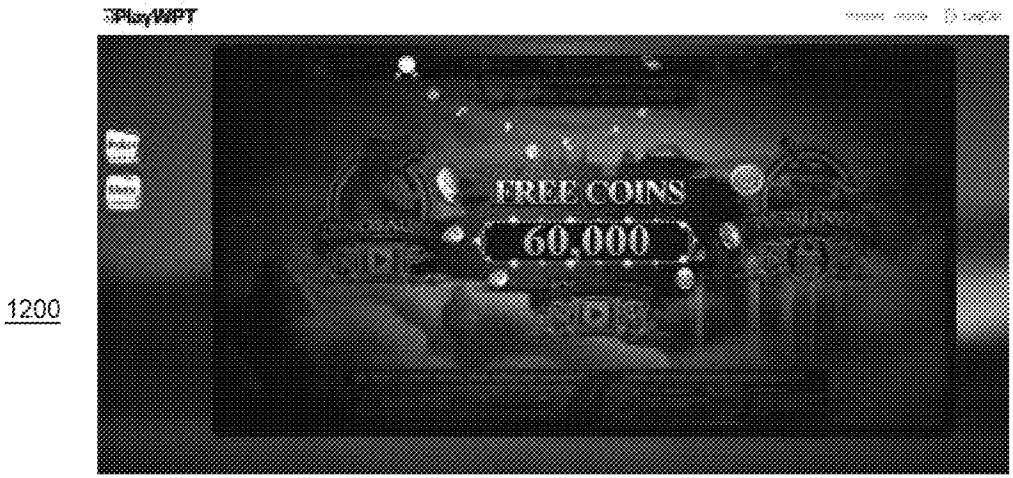
FIG. 12 shows an exemplary screenshot of a payout for a time-gated reward giveaway for a slot game.

Referring to FIG. 11, an exemplary screen shot of a main slot game lobby 1100 is shown. Upon logging in to the server 40, the client application 20*a* may present the player with a main lobby 1100 from which the player may select from a variety of games 1118, 1120 and 1122. The main lobby 1100 may include player indicia 1102 that shows the player's name and current level (e.g. a numerical representation corresponding to a total number of experience points earned for performing in-game actions), silver coin indicia 1104 that shows the player's current silver coins (which may be used to wager within the slot games), and gold coin indicia 1106 that shows the player's current amount of gold coins (which may be used to purchase other in-game items such as silver coins).

The main lobby also may include a time-gated reward chest that may be opened by selecting interface control 1108. In response, the system may distribute a reward to the user, as shown in the exemplary screenshot 1200 in FIG. 12. The amount of the reward may be fixed or variable. In the illustrated embodiment, the system distributes 60,000 silver coins once every three hours to the player in response to the player selection of interface control 1108. Other amounts and intervals also may be used for the time-gated reward chest.

Figure 13A:
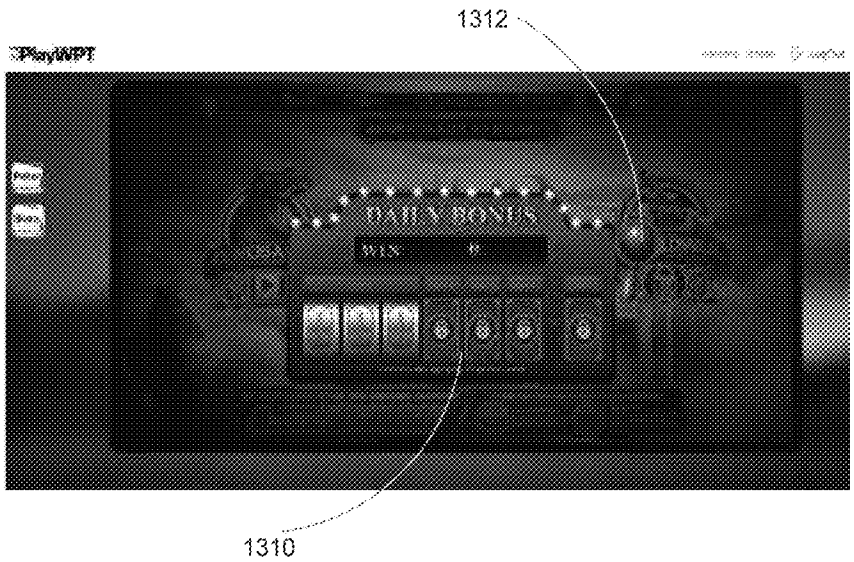
FIG. 13*a-b* show exemplary screenshots of another time-gated reward giveaway.
Figure 13B:
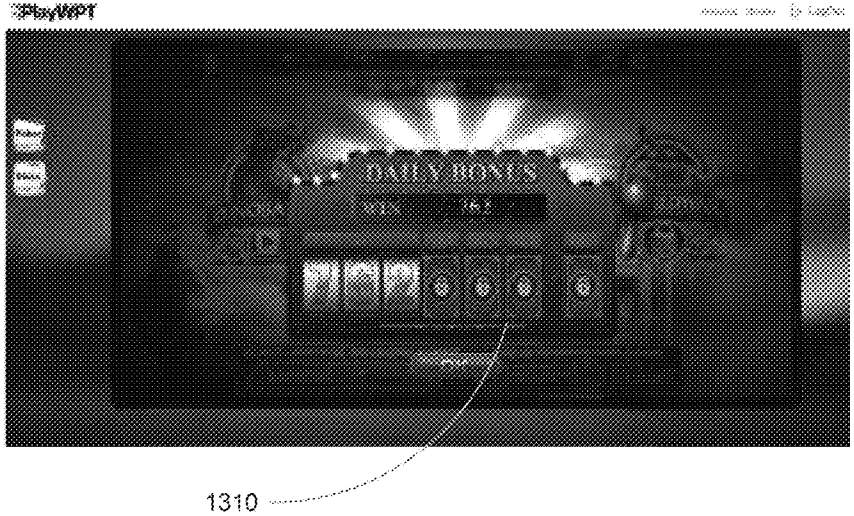

Referring to FIG. 13*a-b*, exemplary screenshots 1300*a* and 1300*b* for an exemplary daily bonus mini-game is shown. Upon logging into the system, a player may be presented with the daily bonus mini-game. In some embodiments, the daily bonus mini-game may be locked until the player reaches a particular level, completes the tutorial, or the like. The daily bonus mini-game may include reels 1310 and a virtual lever 1312. The reels 1310 may include multiple digits and/or a multiplier. Players may select the lever 1312 to spin the reels and win the exact amount of virtual currency as the reels show when it comes to a full stop. By logging into the system on consecutive days, additional digits and/or a multiplier on the reels may be unlocked, which may dramatically increase the potential reward for the player. In the embodiment shown in FIG. 13*b*, the player has won 762 silver coins through the daily bonus reward mini-game.

Figure 14:
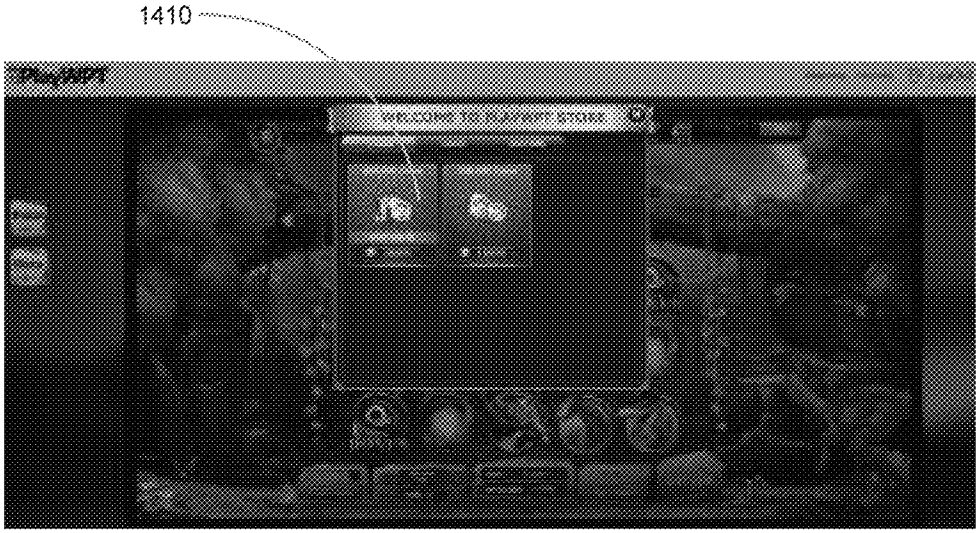
FIG. 14-16 show exemplary screen shots of a virtual currency storefront.
Figure 15:
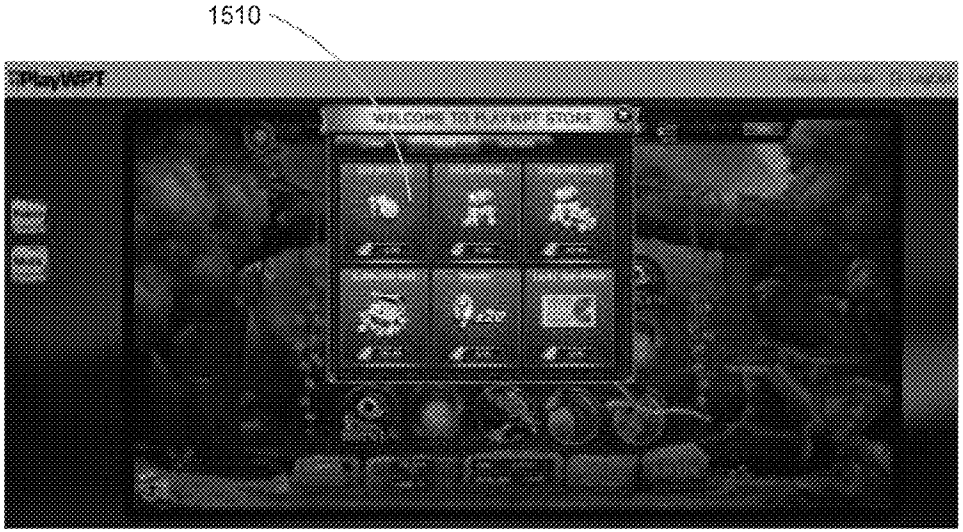
Figure 16:
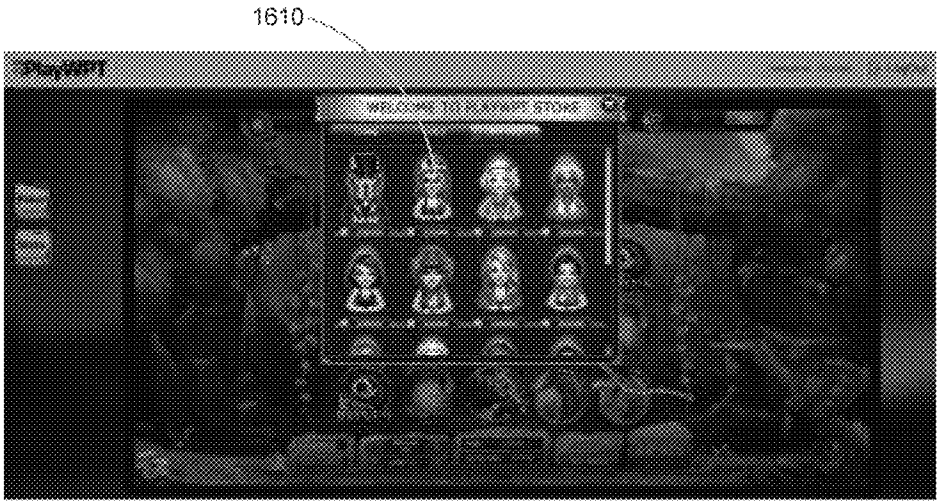

Referring again to FIG. 11, the main lobby 1100 may provide an interface control 1110 that, upon selection by the user, presents the user with the opportunity to purchase various in-game items. Referring also to FIGS. 14-16, exemplary screen shots 1400, 1500 and 1600 of a virtual currency storefront is shown. As shown in FIG. 14, a user may purchase one or more virtual currencies using actual currency or money. In the illustrated embodiment, the user may purchase silver coins 1410 using another virtual currency, gold coins 1510 that may be used to purchase other in-game items.

In some embodiments, the user may be able to purchase additional in-game items using one or more of the virtual currencies. For example, a user may purchase avatars 1610 (as shown in FIG. 16) using gold chips 1510. Avatars 1610 may be icons, 3-D cartoon characters or other images that act as visual representations of the user in the game. In some embodiments, a user may be given a default avatar, such as a dark silhouette.

Figure 17:
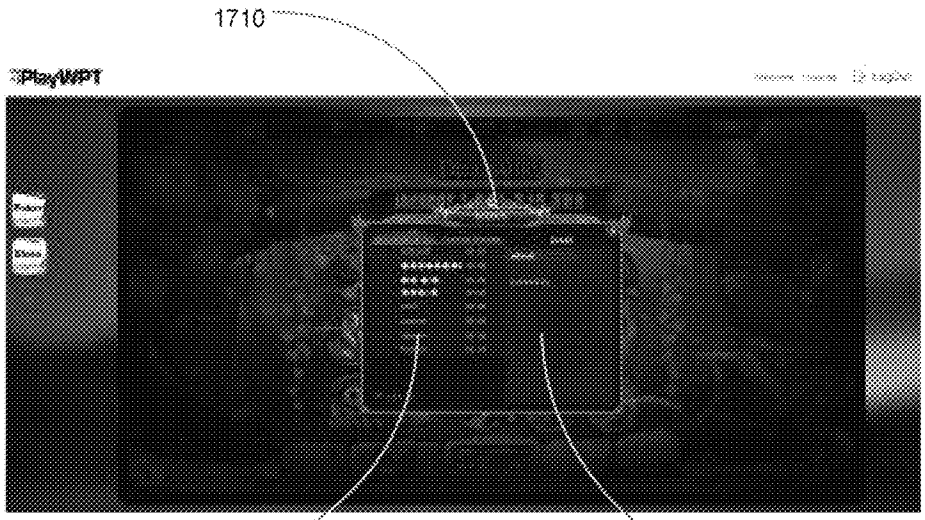
FIG. 17 shows an exemplary screenshot of a message center for use in a slot game.

Referring again to FIG. 11 and also FIG. 17, the main lobby 1100 may include an interface control 1114 to view messages. Upon selection of the control 1114, a pop-up window 1710 may be displayed that shows a lists 1712 of messages from the system or other users. Upon selection of a message from the list 1712, the message body 1714 may be displayed as shown in the exemplary screenshot 1700. Exemplary messages may include promotions such as virtual money package deals, special offers and the like; news such as gaming industry news; game notifications such as game unavailability due to server maintenance; in-game activities such as large payout or weekly leader notifications and the like.

Figure 18:
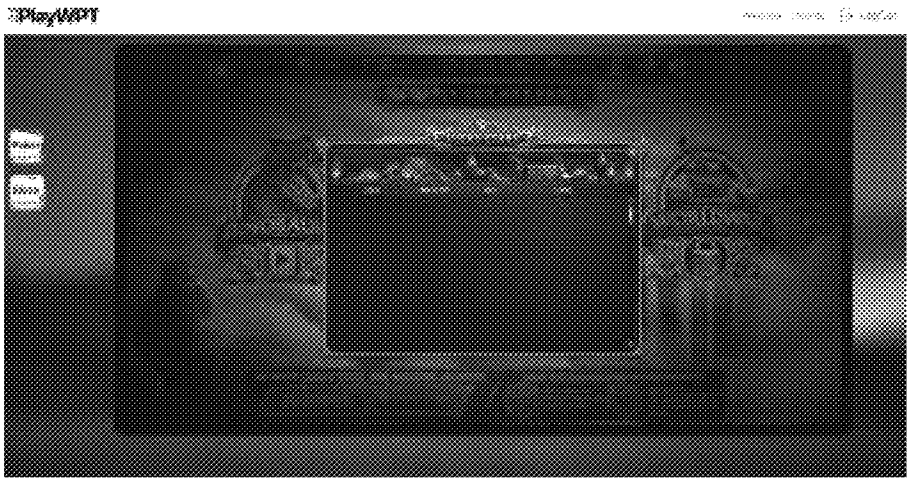
FIG. 18 shows an exemplary screenshot of a leaderboard of progressive jackpot winners in a slot game.

Referring again to FIG. 11, the main lobby 1100 also may include an interface control 1112 to view a leaderboard. FIG. 18 shows an exemplary screenshot 1800 of a leaderboard of progressive jackpot winners in a slot game. The leaderboard may be reset at set intervals.

A system for reducing fraud, hacking and other exploitive behavior in an electronic slot game may comprise a first software module for use on a first device comprising one or more processors and one or more memories and a second software module for use on the server computer comprising one or more processors and one or more memories. The first software module may include instructions stored on a non-transitory computer readable medium that: provide a user interface to a user, the user interface including a reel spin controls that allows a user to spin a virtual slot reel; transmit, to a server computer in response to a selection of the reel spin control, a request for a reel configuration; receive a reel spin configuration and payout amount from the server; determine if the reel spin configuration includes at least one winning combination, the payout amount is greater than zero, or both, and, if so, provide an option to play a reward mini-game in which the user may wager an amount of virtual currency based on the payout amount. The second software module may include instructions stored on a non-transitory computer readable medium that: maintain a progressive pot based on a percentage of wagers made by users; receive the request from the first device; determine the reel spin configuration and the associated payout amount; transmit, to the first device, the reel spin configuration and the associated payout amount; and if the payout amount is greater than zero, subtract the reward amount from the progressive pot.

The reward mini-game may include a player choice of two options and where selection of a first of the two options results in the player winning the amount wagered and where selection of the other of the two options results in the player losing the amount wagered.

The reward mini-game may further include a number of chances that the user may play the reward mini-game.

The chances may be deducted when the player loses the amount wagered.

The player may choose to leave the reward mini-game without selecting either of the two options.

The player may select a multiplier to modify the amount wagered in the reward mini-game.

The multiplier may be one selected from the group comprising a two time multiplier, a three time multiplier and a five time multiplier.

The first software module may further includes instructions stored on a non-transitory computer readable medium that: in response to a user logging into the system for the first time, display an introductory story elements and a tutorial interlaced with additional story elements.

The first software module may further include instructions stored on a non-transitory computer readable medium that: determine if the user has completed a trigger event and, if so, display additional story elements, unlock additional game features.

The first software module may further includes instructions stored on a non-transitory computer readable medium that: display players that have won a progressive jackpot.

While various embodiments of the invention have been described, it will be apparent to those of ordinary skill in the art that many more embodiments and implementations are possible within the scope of the invention. Accordingly, the invention is not to be restricted except in light of the attached claims and their equivalents

We claim:

1. A system for providing a secure electronic game in a mobile application and increasing user retention and interest in the game, comprising:

a first software module executed by a mobile device comprising one or more processors and one or more memories, the first software module including instructions stored on a non-transitory computer readable medium that:

output, via a user interface, a virtual game lobby including one or more games;

detect a user selection corresponding to the one or more games, and, in response, display reel spin controls associated with a virtual slot reel;

transmit, to a server computer in response to a selection of the reel spin control, a request for a reel configuration;

receive a reel spin configuration and payout amount from the server;

determine if the reel spin configuration includes at least one winning combination, and, if the reel spin configuration includes at least one winning combination, distribute the associated payout amount to the user and provide the user with interface controls corresponding to an in-game reward mini-game, wherein the reward mini-game includes a player choice between either of two options and where selection of a first of the two options results in the player winning an amount wagered and where selection of the other of the two options results in the player losing an amount wagered, and wherein the reward mini-game further includes a number of chances that the user may play the reward mini-game;

receive, from the server, an experience level for the user; and determine if the user has completed a trigger event based on the received experience level and, if the user has completed a trigger event, unlock an additional game feature;

and a second software module executed by the server computer comprising one or more processors and one or more memories, the second software module including instructions stored on a non-transitory computer readable medium that:

maintain a progressive pot based on a percentage of wagers made by users;

maintain an experience level corresponding to a total number of experience points earned by the user for completing in-game activities;

receive and validate the request from the mobile device;

determine, in response to the request, the reel spin configuration and the associated payout amount;

authorize the distribution of the payout amount;

award, in response to the request, experience points to the user and update the experience level of the user;

transmit, to the mobile device, the reel spin configuration, the associated payout amount, and the updated experience level of the user; and subtract the payout amount from the progressive pot.

2. The system of claim 1, where chances are deducted when the player loses the amount wagered.

3. The system of claim 2, where the player may choose to leave the reward mini-game without selecting either of the two options.

4. The system of claim 2, where the player may select a multiplier to modify the amount wagered in the reward mini-game.

5. The system of claim 4, where the multiplier is one selected from the group comprising a two time multiplier, a three time multiplier and a five time multiplier.

6. The system of claim 1, where the first software module further includes instructions stored on a non-transitory computer readable medium that:

in response to a user logging into the system for the first time, display introductory story elements and guide the user through a tutorial interlaced with additional story elements.

7. The system of claim 6, where the first software module further includes instructions stored on a non-transitory computer readable medium that:

determine if the user has completed a trigger event and, if the user has completed a trigger event, display additional story elements.

8. The system of claim 1, where the first software module further includes instructions stored on a non-transitory computer readable medium that:

provide a leaderboard interface control that allows the user to view a leaderboard of progressive jackpot winners;

display, in response to a selection of the leaderboard interface control, a leaderboard of progressive jackpot winners; and reset the leaderboard at set intervals.

9. The system of claim 1, where the additional game feature is a daily reward mini-game.

10. The system of claim 9, where the daily reward mini-game includes a plurality of daily reward amounts, and where, in response to determining if the user has participated in the daily reward mini-game on consecutive days, the daily reward amounts are increased.

11. The system of claim 1, where the second software module further includes instructions stored on a non-transitory computer readable medium that:

determine whether the payout is in compliance with reward management rules, and thereby reduce fraud, hacking, and other exploitive behavior.

12. The system of claim 1, where the first software module further includes instructions stored on a non-transitory computer readable medium that:

output a prompt for the user to enter login information; and receive login information from the user.

13. The system of claim 1, where the payout amount is an amount of virtual currency.

14. The system of claim 1, where the virtual game lobby includes player indicia.

15. The system of claim 1, where the virtual game lobby includes locked features that are unlocked in response to a triggering event.

16. The system of claim 1, where the virtual game lobby includes a time gated reward chest.

17. A system for providing a secure electronic game in a mobile application and increasing user retention and interest in the game, comprising:

a first software module executed by a mobile device comprising one or more processors and one or more memories, the first software module including instructions stored on a non-transitory computer readable medium that:

output, via a user interface, a virtual game lobby including one or more games;

detect a user selection corresponding to the one or more games, and, in response, display reel spin controls associated with a virtual slot reel;

transmit, to a server computer in response to a selection of the reel spin control, a request for a reel configuration;

receive a reel spin configuration and payout amount from the server;

determine if the reel spin configuration includes at least one winning combination, and, if the reel spin configuration includes at least one winning combination, distribute the payout amount to the user and provide the user with interface controls corresponding to an in-game reward mini-game, wherein the reward mini-game includes a player choice between either of two options and where selection of a first of the two options results in the player winning an amount wagered and where selection of the other of the two options results in the player losing an amount wagered, and wherein the reward mini-game further includes a number of chances that the user may play the reward mini-game;

receive, from the server, an experience level for the user; and determine if the user has completed a trigger event based on the received experience level, and, if the user has completed a trigger event, unlock an additional game feature.

* * * * *